US009947174B2

(12) United States Patent
Rangarajan et al.

(10) Patent No.: US 9,947,174 B2
(45) Date of Patent: Apr. 17, 2018

(54) COMPUTER SYSTEM FOR MULTIPLE USER, MULTIPLE EVENT REAL-TIME ONLINE WAGERING

(71) Applicant: Microsoft Corporation, Redmond, WA (US)

(72) Inventors: Nikhil Devanur Rangarajan, Bangalore (IN); David Pennock, Princeton, NJ (US); Jennifer Wortman Vaughan, New York, NY (US); Yiling Chen, Cambridge, MA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 758 days.

(21) Appl. No.: 14/529,122

(22) Filed: Oct. 30, 2014

(65) Prior Publication Data

US 2016/0125691 A1 May 5, 2016

(51) Int. Cl.
*G07F 17/32* (2006.01)

(52) U.S. Cl.
CPC ..... *G07F 17/3225* (2013.01); *G07F 17/3244* (2013.01); *G07F 17/32* (2013.01)

(58) Field of Classification Search
CPC ..... G06F 17/32
See application file for complete search history.

(56) References Cited

U.S. PATENT DOCUMENTS 5,687,968 A 11/1997 Tarantino
6,464,583 B1 10/2002 Kidron
8,275,695 B2 9/2012 Lange et al.
8,396,777 B1 3/2013 Fine et al.
8,589,233 B2 11/2013 Flake et al.
8,734,227 B2 5/2014 Leen
8,876,610 B1 11/2014 Curtis
9,257,015 B2 2/2016 Cornett
2013/0029755 A1* 1/2013 Villarreal ..... G07F 17/3244 463/25

(Continued)

OTHER PUBLICATIONS

M Ali, Mukhtar., "Probability and Utility Estimates for Racetrack Bettors", In Journal of Political Economy, vol. 85, No. 4, Aug. 1997, 8 pages.

(Continued)

*Primary Examiner* — James S McClellan
*Assistant Examiner* — Syvila Weatherford
(74) *Attorney, Agent, or Firm* — Patent GC LLC

(57) ABSTRACT

A computer system includes a server computer that handles transactions with user devices to create and manage events, create and manage user accounts and process wagers. Transactions regarding wagers in connection with events can be processed in real-time. The wagers are processed using a payoff function that rewards participation and accurate information, yet does not permit arbitrage or otherwise reward splitting a wager by participating under multiple identities. To compute a payoff, a first score is computed based on the probability estimate by a participant and the outcome. A second score is computed based on an aggregate of wagers of all other participants for each participant, where the first score for the participant is no more than the second score for at least one outcome. The payoff for the participant is then computed as a function of the first score and the second score.

29 Claims, 7 Drawing Sheets

(56) References Cited

U.S. PATENT DOCUMENTS

2014/0113713 A1* 4/2014 Fontaine ..... G07F 17/3262 463/28
2014/0274332 A1* 9/2014 Carlin ..... G07F 17/3244 463/25

OTHER PUBLICATIONS

Allen, et al., "Stock-price manipulation", In Review of Financial Studies, vol. 5, Issue 3, Retrieved on: May 9, 2014, pp. 502-529.
Berg, et al., "Results from a dozen years of election futures markets research", In Handbook of Experimental Economic Results, Nov. 2000, 12 pages.
Brier, Glenn W., "Verification of forecasts expressed in terms of probability", In proceedings of Monthly Weather Review, vol. 78, Issue 1, Jan. 1950, 3 pages.
Chakrabortya, et al., "Manipulation in market order models", In Journal of Financial Markets vol. 7, Issue 2, Feb. 2004, pp. 187-206.
Chen, et al., "Information Markets vs. Opinion Pools: an Empirical Comparison", In Proceedings of the 6th ACM conference on Electronic commerce, Jun. 5, 2005, pp. 58-67.
Chen, et al., "Gaming Prediction Markets: Equilibrium Strategies with a Market Maker", In Journal of Algorithmica, vol. 58, Issue 4, Dec. 2010, 41 pages.
Chun, et al., "Strictly Proper Mechanisms with Cooperating Players", In Proceedings of the Twenty-Seventh Conference on Uncertainty in Artificial Intelligence, Jul. 14, 2011, 10 pages.
Dani, et al., "An Empirical Comparison of Algorithms for Aggregating Expert Predictions", In Proceedings of the 22nd Conference in Uncertainty in Artificial Intelligence, Jul. 13, 2006, 8 pages.
Forsythe, et al., "Information aggregation in an experimental market", In Journal of the Econometric Society, vol. 58, No. 2, Mar. 1990, pp. 309-347.
Gandar, et al., "Informed traders and price variations in the betting market for professional basketball games", In the Journal of Finance, vol. 53, Issue 1, Feb. 1998, pp. 385-401.
Gao, et al., "What you jointly know determines how you act: Strategic interactions in prediction markets", In Proceedings of the fourteenth ACM conference on Electronic commerce, Jun. 16, 2013, 18 pp. 489-506.
Gneiting, et al., "Strictly Proper Scoring Rules, Prediction, and Estimation", In Journal of the American Statistical Association, vol. 102, No. 477, Mar. 2007, pp. 359-378.
Good , I.J., "Rational decisions", In Journal of the Royal Statistical Society. Series B (Methodological), vol. 14, No. 1, Retrieved on: May 9, 2014, pp. 107-114.
Grossman, Sanford., "On the efficiency of competitive stock markets where traders have diverse information", In the Journal of Finance, vol. 31, Issue 2, May 1976, pp. 573-585.
Hansen, et al., "Manipulation in political Stock Markets—Preconditions and Evidence", In Technical Report, Retrieved on: May 7, 2014, 11 pages.
Jacobs, Robert A., "Methods for combining experts' probability assessments", In journal of Neural Computation, vol. 7, Issue 5, Sep. 1, 1995, pp. 867-888.
Johnstone, David J., "The parimutuel kelly probability scoring rule", In Journal of Decision Analysis, vol. 4, Issue 2, Jun. 1, 2007, 2 pages.
Page, Scott E., "The Difference: How the Power of Diversity Creates Better Groups, Firms, Schools, and Societies", In Publication of Princeton University Press, Jan. 15, 2007, 3 pages.
Kilgour, et al., "Elicitation of Probabilities Using Competitive Scoring Rules", In Journal of Decision Analysis, vol. 1, Issue 2, Jun. 1, 2004, 2 pages.
Kumar, et al., "Futures manipulation with cash settlement", In the Journal of Finance, Sep. 1992, 2 pages.
Lambert, et al., "An Axiomatic Characterization of Wagering Mechanisms", In Technical report, Working paper, Mar. 24, 2014, 34 pages.
Lambert, et al., "Self-financed wagering mechanisms for forecasting", In Proceedings of the 9th ACM conference on Electronic commerce, Jul. 8, 2008, pp. 170-179.
Matheson, et al., "Scoring Rules for Continuous Probability Distributions", In Management Science vol. 22, Issue10, Jun. 1976, 2 pages.
Milgrom, et al., "Information, trade and common knowledge", In Journal of Economic Theory, vol. 26, Issue 1, Feb. 1982, 11 pp. 17-27.
Ostrovsky, Michael., "Information aggregation in dynamic markets with strategic traders", In Journal of the Econometric Society, vol. 80, No. 6, Nov. 2012, 54 pages.
Roll, Richard., "Orange juice and weather", The American Economic Review, vol. 74, Issue 5, Dec. 1984, pp. 861-879.
Savage, Leonard J., "Elicitation of personal probabilities and expectations", In Journal of the American Statistical Association, vol. 66, No. 336, Dec. 1971, pp. 783-801.
Surowiecki, et al., "The Wisdom of Crowds: Why the many are smarter than the few and how collective wisdom shapes business, economies, societies, and nations", In Doubleday, Aug. 16, 2005, 14 pages.
Ungar, et al., "The Good Judgment Project: A large Scale Test of Different Methods of Combining Expert Predictions", In Proceedings of of AAAI Technical Report, Nov. 2, 2012, pp. 37-42.
Winkler, Robert L., "Scoring Rules and the Evaluation of Probability Assessors", In Journal of the American Statistical Association, vol. 64, Issue 327, Sep. 1969, 7 pages.
Wolfers, et al., "Prediction Markets", In the Journal of Economic Perspectives, vol. 18, Issue 2, May 2004, 287 pages.
Nau, Robert, "Arbitrage, Incomplete Models, and Other People's Brains", In Proceedings of Beliefs, Interactions and Preferences in Decision Making, Sep. 16, 2006, 20 pages.
Martin, Jerome, "Information Aggregation Efficiency in Virtual Prediction Markets", In Master Thesis, Sep. 13, 2006, 115 pages.
Chen, Yiling, "Prediction Markets: Economics, Computation, and Mechanism Design", In Proceedings of Economics & Computer Science, Jun. 2007, 74 pages.

* cited by examiner

Event data 200
- identifier 202
- possible outcomes 204
- termination conditions 206
- status information 208

Wager data 230
- identifier 232
- event identifier 234
- participant identifier 236
- probability distribution 238
- amount 240

Participant Data 260
- identifier 262
- identification information 264

FIG. 2

COMPUTER SYSTEM FOR MULTIPLE USER, MULTIPLE EVENT REAL-TIME ONLINE WAGERING

BACKGROUND

A computer-implemented prediction market is an efficient tool for gathering opinion data from the general public and other users. One form of computer-implemented prediction market is an online wagering system. By making wagers, users reveal their predictions about the likely outcome of the event. Because prediction markets tie economic participation with providing information about beliefs, users are more likely to provide information indicative of their true beliefs. Consequently, such prediction markets tend to provide better information about actual beliefs and opinions than polling and surveys.

In some wagering systems, it may be possible for a participant to place a wager in which the participant is guaranteed a positive payoff. In other words, the participant can risklessly make a profit. Such a possibility is sometimes called an arbitrage opportunity. In wagering systems where arbitrage opportunities can occur, a service center that is hosting the wagering system can lose money. Further, depending on the incentives created by the payoff function, users otherwise may make wagers that are not based on their true beliefs.

SUMMARY

This Summary is provided to introduce a selection of concepts in a simplified form that are further described below in the Detailed Description. This Summary is intended neither to identify key or essential features, nor to limit the scope, of the claimed subject matter.

A computer system hosts a multi-user, multi-event real-time online wagering system. The computer system includes a server computer that handles transactions with user devices to create and manage events, create and manage user accounts and process wagers. Transactions regarding wagers in connection with events can be processed in real-time. The wagers are processed using a payoff function that rewards participation and accurate information, yet does not permit arbitrage or otherwise reward splitting a wager by participating under multiple identities. An example of such a wagering system with such a payoff function is a weighted score wagering mechanism. There are several technical aspects of implementing such an online wagering system.

Prior to the outcome of an event being determined, a computer system receives messages including wager information for the event from user devices. The computer system can receive messages for multiple events being managed by the computer system. The computer system determines whether wagers are valid and stores wager information in persistent storage. The computer system continually monitors current time to determine whether to close the event. When the event is closed, wager data can be read from persistent storage into memory for processing of payoffs for the event.

To compute the payoff function, for example, a processor computes a first score for a participant based on the probability estimate from the wager by the participant and the outcome. A processor computes a second score based on an aggregate of wagers of all other participants, wherein, for each participant, the first score for the participant is less than the second score for at least one outcome. The payoff for the participant is then computed as a function of the first score and the second score.

In the following description, reference is made to the accompanying drawings which form a part hereof, and in which are shown, by way of illustration, specific example implementations of this technique. It is understood that other embodiments may be utilized and structural changes may be made without departing from the scope of the disclosure.

DESCRIPTION OF THE DRAWINGS

FIG. 2 illustrates an example implementation of database tables.

DETAILED DESCRIPTION

Figure 1:
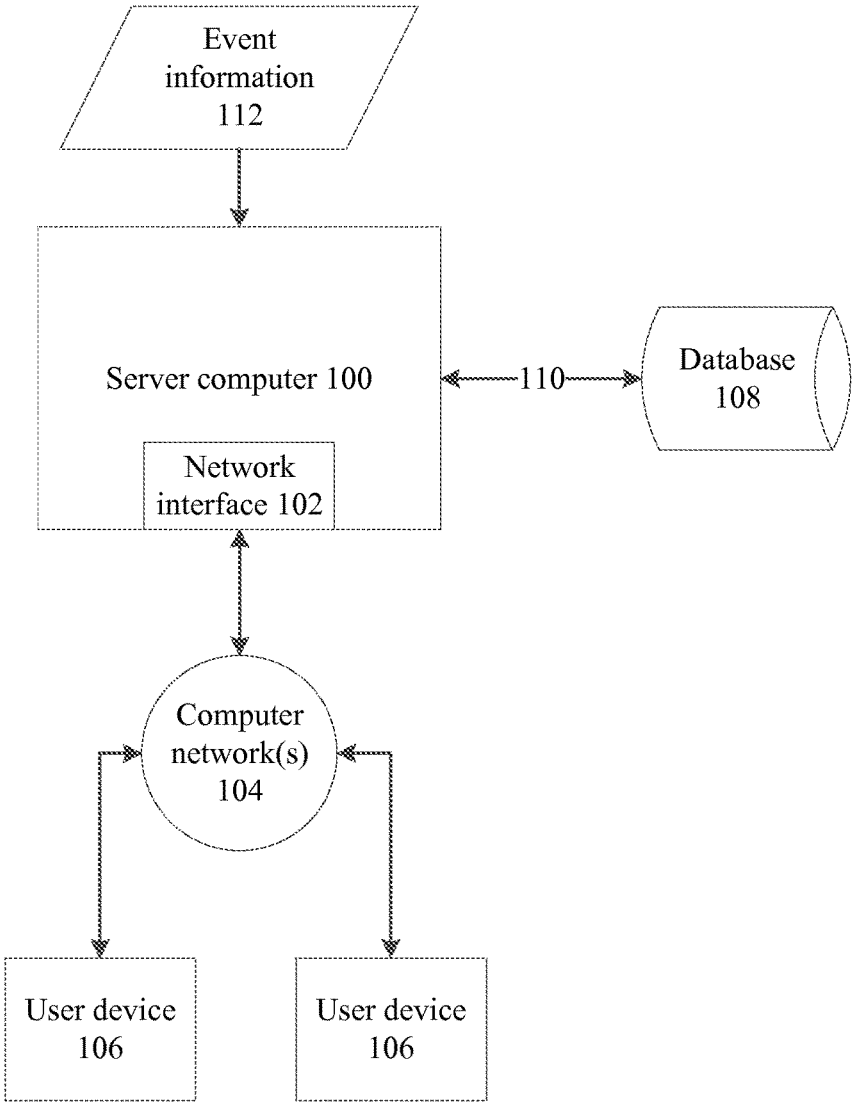
FIG. 1 is a block diagram of an example application environment in which a computer system hosts a multiple user, multiple event, real-time online wagering system.

A computer system hosts an online wagering system, allowing multiple users to make wagers with respect to one or more events. Information provided through the wagers made by multiple users for an event can be aggregated to provide prediction information about the likely outcome of the event. The online wagering system computes payoffs for each event after outcomes of the events are known.

An event can be any kind of occurrence for which the outcome is not known, and for which multiple outcomes are possible. In the example implementation described below, the possible outcomes can be represented mathematically as a binary random variable; however, the implementation is readily generalized to any finite discrete random variable. A time period starting sometime before the event and ending just prior to the outcome of the event being known is the period of time the event is active. When an event is active, the computer system can accept wagers for the event. A wager is generally an amount in some unit of measurement, typically money, associated with a possible outcome of the event. If an event is inactive (either the starting time, if any, has not arrived or the event ended), then the computer system does not accept wagers for that event. At some point after the event ends, the computer system processes the wagers for the event to determine a payout, if any, for each user, according to a scoring rule. Prior to the event ending, some wagering mechanisms may allow a participant to see prior wagers, whether in detail or in some aggregate form.

A particular kind of wagering system which this computer system can be used to support is a one-shot betting mechanism in which participants are expected to have immutable beliefs. In such a wagering system, each participant makes a prediction about an uncertain event, in the form of a probability distribution over a set of candidate outcomes, and wagers some amount of money. The total amount wagered is used to distribute payoffs among the participants after the event outcome is revealed.

If such a one-shot betting mechanism satisfies a certain set of properties, it is called a weighted score wagering mechanism. These properties are: 1) budget balance: the sum of participants' payoffs is zero, or can be less than zero, and the service center hosting the event does not subsidize betting or can make a profit; 2) individual rationality: each participant prefers participating to not participating; 3) incentive compatibility: each participant maximizes his expected payoff by predicting the participant's true belief; and (4) sybilproofness: each participant cannot benefit by splitting a wager by participating under multiple identities.

An example of a one-shot betting mechanism is an automated trading system in which advertisement conversion rates are predicted, which in turn informs advertisement placement in online systems. To inform ad placement, such betting happens in milliseconds, and participants generally use automated, machine learning systems to form predictions and place wagers in real time.

Implementation on a computer system allows a central service to offer access for multiple users to wagering in multiple events in real time across various geographies.

Such a computer system includes one or more computers, such as described below in connection with FIG. 6, which connect to one or more computer networks through one or more network interfaces and to a database that stores information in persistent storage. Users access the one or more computers through user devices that connect to the one or more computer networks. User devices also are typically a form of computer such as described below in connection with FIG. 6. The computer system collects and stores data about users, events, and wagers from multiple users for multiple events over periods of time.

The computer system collects data for each event and stores the data for the period of time the event is active. The computer system makes an event available in which users can participate. The computer system processes transactions for the event, and tracks time for the event to enforce opening and closing of the event, and collects wagers and information about users, provides prediction information based on the wagers prior to the outcome of the event, and clears the event at the end of the event by computing payoffs.

Referring to FIG. 1, an example implementation of such a computer system and its operating environment to provide an online wagering service will now be described.

In FIG. 1, a server computer 100, which can be one or more computers, is maintained by a central service to host a computer system through which users to place wagers on events. The server computer 100 has one or more network interfaces 102 to connect to one or more computer networks 104. The computer network 104 allows user devices 106 to connect to and communicate with the server computer 100.

The server computer 100 also connects to one or more databases 108 through connection 110. The database 108 stores information about events, users and wagers placed for events. Depending on the implementation of the database 108, such a connection 110 can be provided by a computer network, a computer bus, or other communication connection to access data in persistent storage. An example implementation of the database is described in more detail in connection with FIG. 2 below.

In general, in operation, users cause user devices 106 to access the server computer 100. The server computer 100 provides data about events from the database 108 to the user devices 106, and receives data from user devices about users, selected events, and wagers to be placed for users for those events, and stores the received data in the database 108. The server computer also receives information 112 about events, including times and possible outcomes of those events, and stores that information in the database. The server computer 100 also accesses a time of day timer, allowing it to do real time starting and stopping of wagering for each event, based on each event's starting time (if any) and ending time.

There are a variety of possible implementations of such a computer system, depending on the environment in which it is deployed.

For example, the server computer may be connected to a publicly accessible computer network, such as the internet, and can accept connection requests from any kind of user device that can connect to the internet and communicate user, event and wager information to and from the server computer to the user device. In such a case, the user device can be a mobile phone, television set top box, smart television, personal computer, portable computer, tablet, slate or other handheld computer, game console or the like.

As another example, the server computer and computer network can be deployed in a privately accessed facility, with a private local area network to which user devices can connect. User devices in such an implementation may include computer terminals, personal general purpose computers, and point of sale computers, dedicated to the function of placing wagers for events.

As another example, the server computer and computer network can be deployed for access by user devices that are programmed to participate automatically in events on behalf of individuals or organizations. In such an implementation, the user devices may be a computer that acts as an interface to a machine learning system that is processing information to make predictions and wagers.

Referring to FIG. 2, an example implementation of a database will now be described.

The computer system stores data describing events 200, participants 260 and wagers 230.

For events, the computer system can store, for each event, an identifier 202 for the event, a plurality of possible outcomes 204 of the event, and termination conditions 206 for the event, such as a time. Any other status information 208 for the event can be stored, such as whether it is already closed, and any other descriptive information for the event.

For wagers, the computer system can store an identifier 232 of the wager, an identifier 234 of the event for which the wager is placed, an identifier 236 of a participant making the wager, a probability distribution 238 over the plurality of possible outcomes for the event, and an amount 240. Other information 242 also can be stored, such as the time at which the wager was made, or whether the wager was valid.

For participants, the computer system can store an identifier 262 of the participant and various identification information 264. For example, payment methods and contact information may be stored.

With such an implementation, the database can be implemented using a relational database including tables of data stored in tables in persistent storage and accessible through a relational database management system. Using such information it is possible to identify all wagers placed by a participant, and thus all events in which the participant placed wagers. The computer system also can query the database to identify all participants in an event, and all wagers in an event.

A similar database can be implemented using an object oriented database management system, or in data files accessed through a file system of an operating system of a computer. Such data files can be stored in persistent storage local to the server computer (i.e., connected over a bus) or in persistent storage accessed over a computer network.

Figure 3:
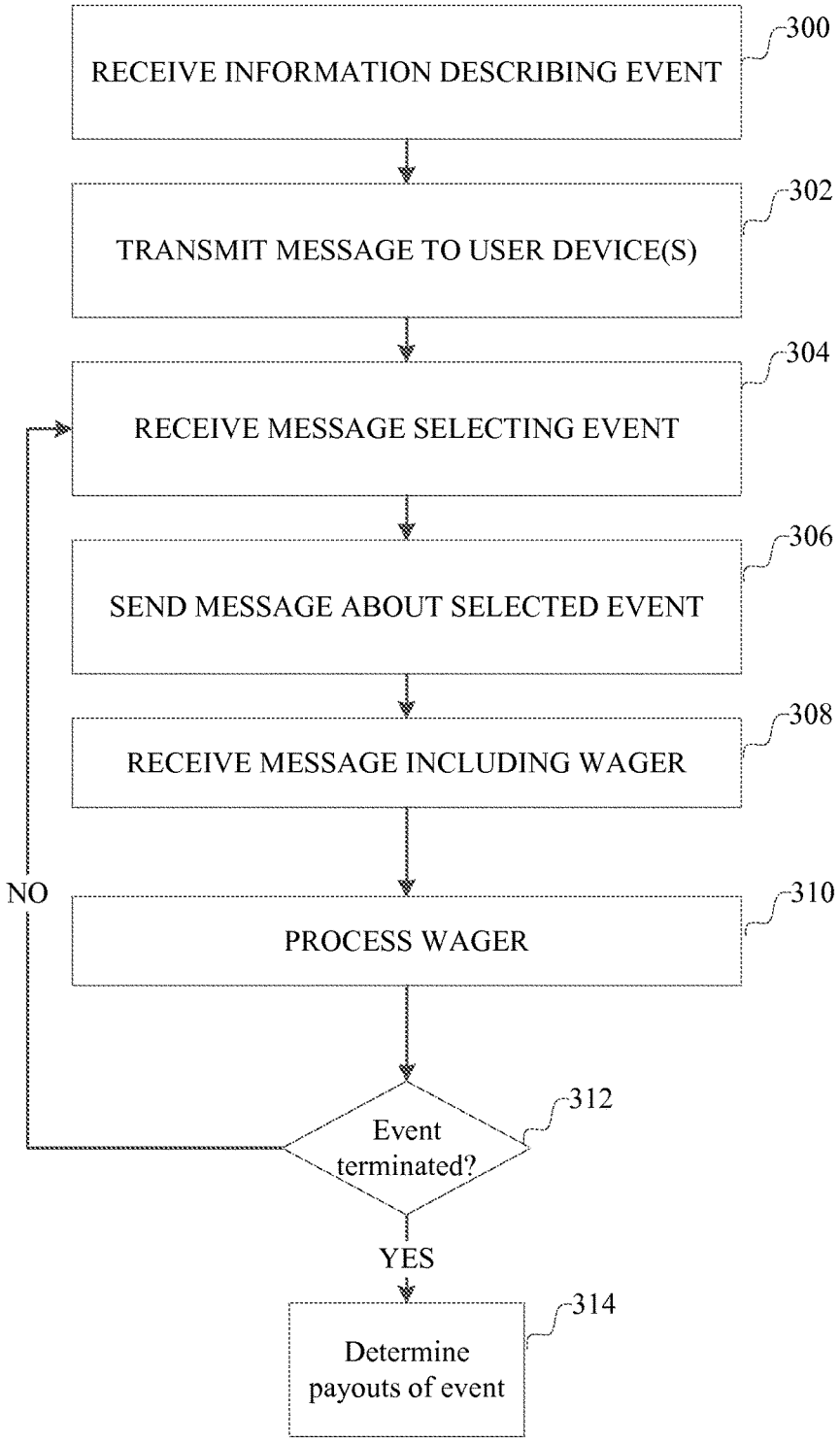
FIG. 3 is a flow chart describing an example implementation of hosting an event.

Referring now to FIG. 3, a flowchart of an example implementation of operation of an exchange for an event will now be described. To make an event available for wagering, the computer system receives 300 information describing the event and stores this information in the database.

When each user device first accesses the computer system, the computer system transmits 302 a message to the user device including data describing events which are currently available for wagering for the user associated with the user device. To select an event, a user instructs the user device to transmit a message with the data describing the selected event. The computer system then receives 304 a message from the user device indicating the selected event.

Given a selected event, the computer system can send 306 a message to the user device with information allowing the user associated with the user device to place a wager. This information sent in this message may include the possible outcomes for which a probability distribution can be defined in a wager, and other information that, when processed at the user device, allows the user device to provide a mechanism that allows the user to enter an amount and probability distribution for the wager. In some wagering systems, information about prior wagers of other participants can be provided. Such information can be aggregated in some form or detailed. To place a wager, the user instructs the user device to transmit a message with data describing the wager to the server computer, which the server computer receives 308.

The server computer processes 310 wagers from user devices for the event. Such processing can include verifying that each wager is valid, such as whether the user is authorized or whether the wager is placed during the time period for the event. Such processing of user access, event selection and wagers continues until the server computer detects the termination of the event, as indicated at 310. After an event terminates, the system determines payouts and closes 312 out the event.

The determination of the payout is described in more detail below in connection with FIG. 5. Participants in the wagering system can be informed of how payouts are computed, and thus would be aware that opportunities for arbitrage are eliminated due to the nature of the payout function.

Now, the computer system generally performs the operational steps set forth in FIG. 3 asynchronously with other operations for other events managed by the computer system. Thus, after processing incoming information describing an event, the computer system may then process a wager received for another event, and may then process the closing procedures of yet another event that has terminated. Thus, the architecture of the server computer is transactional, with the computer system processing different types of transactions asynchronously across various events. Such types of transactions include adding a user, adding an event, offering events to a user, a user selecting an event, a user placing a wager, and closing an event.

Figure 4:
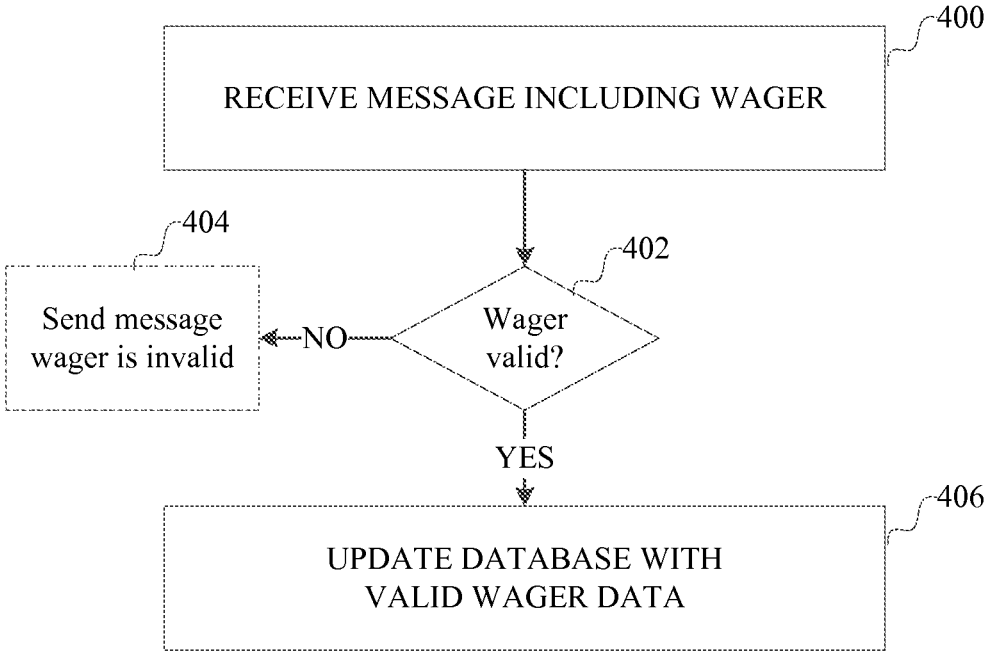
FIG. 4 is a flow chart describing an example implementation of processing a wager from a user for an event.

Referring now to FIG. 4, a flowchart of an example implementation of processing incoming messages from users will now be described. The server computer receives 400 a message including data describing a wager. The server computer determines 402 if the wager is valid. If the wager is not valid, the server computer can send 404 a message to the user device indicating the wager is not accepted. Invalid wager information also can be stored in the database, and marked as such, for various tracking purposes.

Whether a wager is valid can include a number of different tests. A user may not be authorized to place the wager for the event. The event may be closed (or not yet started). The wager may exceed boundaries set for wagers for the event or for the user or by the service provider. The probability distribution provided in the wager may be incorrect or incomplete.

If the wager can be accepted, then the server computer updates 406 the database with the valid wager for the event.

Figure 5:
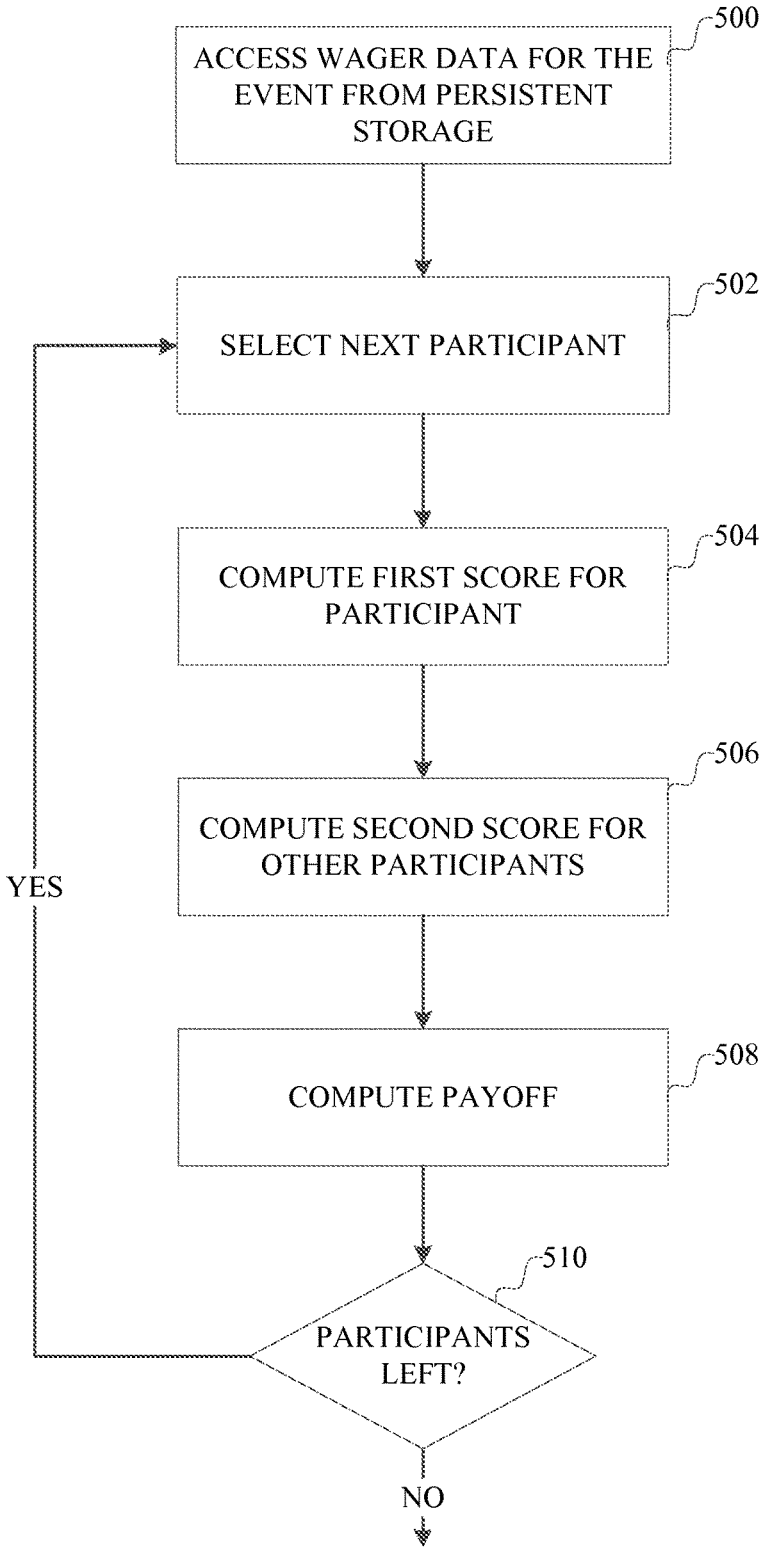
FIG. 5 is a flowchart describing an example implementation of determining payout for possible outcomes of an event to avoid arbitrage opportunities.

FIG. 5 will now be used to describe how a set of wagers for an event can be processed to provide payouts. In particular, upon termination of an event, the computer system processes wager information in the persistent storage according to a payoff function for the event so as to determine a payoff for each participant having placed a wager based on an actual outcome of the event. The wager information can be read 500 from persistent storage into a data structure in memory to be more quickly accessed by the processor during processing.

In one implementation a weighted score wagering mechanism can be used. Such a payoff function has the characteristic that, within any arbitrage interval, some value can be subtracted from each payoff which is a) independent of the participant's prediction and b) which prevents the payoff from being positive.

Generally speaking, payoff functions having a form that involves computing, for each participant, a first score for the participant based on that participant's wager and the actual outcome, and a second score based on an aggregate of the other participants. A weighted difference of these scores is computed as the payoff. The difference between these two scores is weighted such that, for each participant, there is at least one actual outcome for which the payoff to the participant is zero or less than zero.

In one example implementation, the server computer computes the payoff function for a participant by selecting 502 the participant. Next the server computer computes 504 a first score. Then the server computer computes 506 a second score. The server computer then computes 508 a function of the first score and the second score to provide the payoff for that participant. So long as participants remain to be processed, as determined at 510, the server computer can select 502 the next participant and repeat computations 504 to 508.

Figure 7:
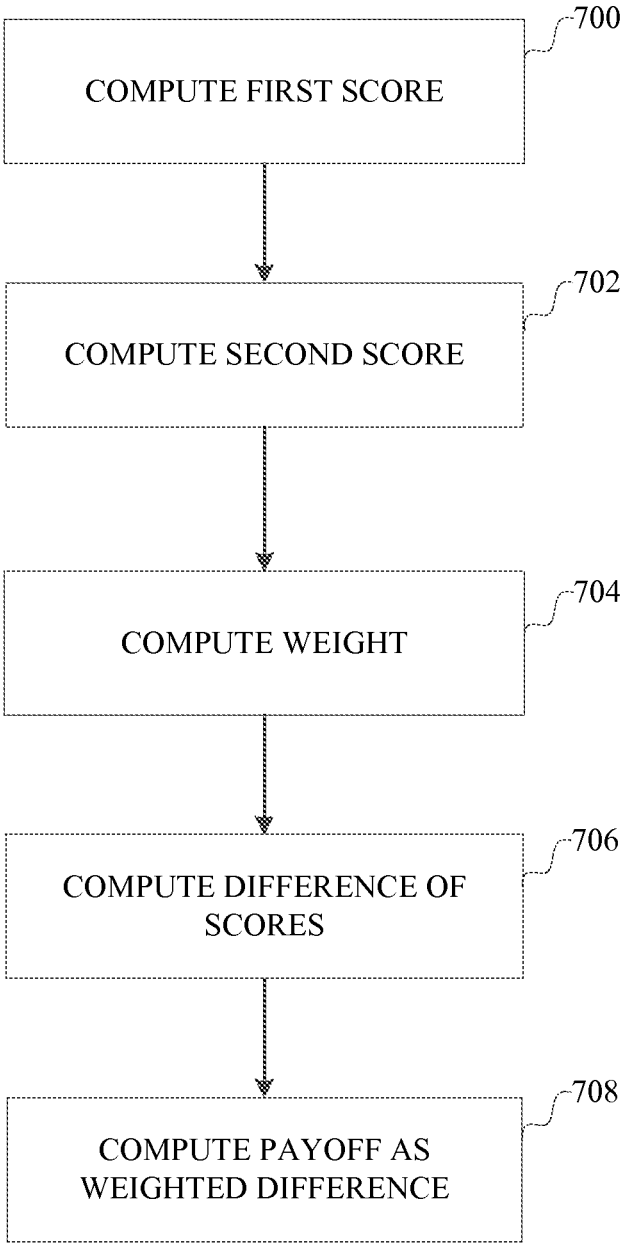
FIG. 7 is a flowchart describing an example implementation of computing a payoff function.

A flowchart describing the computation of the payoff for a participant will now be described in more detail in connection with FIG. 7.

First, a first score for the participant is computed 700. The processor is instructed to compute this first score by retrieving the wager data for the participant from memory and applying the function for determining the first score. The first score generally is a function of the probability estimate from the wager by that participant and the actual outcome. For example, the first score can be a function of the squared difference between the probability estimate from the wager by the participant and the actual outcome. The processor can be instructed to compute 1 minus this squared difference.

Next, the processor computes 702 a second score for the participant based on an aggregate of wagers of all other participants. The function for computing the second score is such that, for each participant, the first score for the participant is no more than the second score for at least one outcome. For example, the processor can be instructed to compute a sum, over all other participants, of the amounts of the wagers times the probability distributions from the wagers by the other participants, divided by a total of the amounts of the wagers of the other participants.

The payoff for the participant is then computed as a function of the first score and the second score. For example, a difference between the first score and second score can be computed 706. The order of computation of the difference and weight is immaterial.

A weight for the participant can be computed 704 based on the amount of the wager of the participant and the amounts of wagers of other participants. To compute the weight, the processor can be more particularly instructed to compute a function of the amount of the wager of the participant and a total of the amounts of the wagers of all other participants. More particularly, the processor can be instructed to compute the amount of the wager of the participant times a total of the amounts of the wagers of all other participants divided by a total number of all participants.

The payoff can be computed 708 using the weight and the difference between the first score and the second score. Particularly, the processor can be instructed to compute the weight times this difference.

Accordingly, in one aspect, a computer system comprises a server computer, comprising a processor and memory connected to the processor to allow access by the processor to data stored in the memory, and persistent storage connected to the processor to allow access by the processor to data stored in the persistent storage, and a network interface connected to the processor and the memory to allow access by the computer to a computer network and communicate messages over the computer network.

Computer program instructions are stored in at least one of the memory and persistent storage of the server computer that, when processed by the processor, instruct the processor to perform various actions. While each event is active, the processor receives messages over the computer network from user devices, received messages each including data indicative of an event, data indicative of a wager for the event, and data indicative of a participant, wherein the data indicative of the wager includes data indicative of at least an amount and a probability distribution for outcomes for the event. The processor processes each message to determine if the message includes a valid wager. The processor stores the data indicative of the wager, the participant and the event in the persistent storage if the message includes a valid wager. The processor receives data indicative of a termination condition for each event to determine whether the event has terminated. Upon termination of an event, the processor processes the data indicative of valid wagers for the event stored in the persistent storage according to a payoff function for the event and an actual outcome of the event, so as to compute a payoff for each participant having placed a valid wager for the event. To compute the payoff function the processor is instructed to compute a first score for the participant based on the probability estimate from the wager by the participant and the outcome, compute a second score based on an aggregate of wagers of all other participants, wherein, for each participant, the first score for the participant is no more than the second score for at least one outcome, and compute the payoff of the participant as a function of the first score and the second score.

The invention may be embodied as a computer system, as any individual component of such a computer system, as a process performed by such a computer system or any individual component of such a computer system, or as an article of manufacture including computer storage in which computer program instructions are stored and which, when processed by one or more computers, configure the one or more computers to provide such a computer system or any individual component of such a computer system.

In one aspect, the server computer includes a means for processing messages related to wagers for events, a means for detecting a termination condition of an event, and a means processing data indicative of valid wagers for the event to compute a payoff for each participant upon termination of the event. To compute the payoff function, the server computer includes a means for computing a first score for the participant based on the probability estimate from the wager by the participant and the outcome, a second score based on an aggregate of wagers of all other participants, and wherein, for each participant, the first score for the participant is no more than the second score for at least one outcome, and computing the payoff of the participant as a function of the first score and the second score.

In one aspect, the server computer includes a transaction processing module that has inputs receiving messages related to wagers for events and outputs storing data for valid wagers in persistent storage, a termination monitoring module that has inputs receiving data indicative of the status of events and outputs indicating that an event has terminated, and a payoff calculation module that has inputs connected to the outputs of the termination monitoring module indicating termination of an event, and inputs for receiving valid wager data from the persistent storage, and outputs providing payoff data for each valid wager of a terminated event, wherein, to compute the payoff function, the server computer includes a means for computing a first score for the participant based on the probability estimate from the wager by the participant and the outcome, a second score based on an aggregate of wagers of all other participants, and wherein, for each participant, the first score for the participant is no more than the second score for at least one outcome, and computing the payoff of the participant as a function of the first score and the second score.

In any of the foregoing aspects, to compute the payoff function, the processor reads data for wagers from the persistent storage into memory and computes functions of the data in the memory.

In any of the foregoing aspects, to compute the function of the first score and the second score, the processor can be further instructed to compute a difference between the first score and the second score, compute a weight for the participant based on the amount of the wager of the participant and the amounts of the wagers of other participants, and compute the payoff using the weight and the difference between the first score and the second score.

In any of the foregoing aspects, to compute the payoff using the weight and the difference, the processor can be instructed to compute the weight times the difference.

In any of the foregoing aspects, to compute the weight for the participant, the processor can be instructed to compute a function of the amount of the wager of the participant and a total of the amounts of the wagers of all other participants.

In any of the foregoing aspects, to compute the weight for the participant, the processor can be instructed to compute the amount of the wager of the participant times a total of the amounts of the wagers of all other participants divided by a total number of all participants.

In any of the foregoing aspects, to compute the first score, the processor can be instructed to compute 1 minus a squared difference between the probability estimate from the wager by the participant and the actual outcome.

In any of the foregoing aspects, to compute the second score, the processor can be instructed to compute a sum, over all other participants, of the amounts of the wagers times the probability distributions from the wagers by the other participants, divided by a total of the amounts of the wagers of the other participants.

In any of the foregoing aspects, the persistent storage can include a database that stores the data indicative of the events, the wagers and the participants.

In any of the foregoing aspects, the computer system can further include a database, comprising: a database computer executing a database management system, the database computer including the persistent storage and connected to the server computer over a computer network, the database computer responsive to requests from the server computer to access data stored in the persistent storage.

In any of the foregoing aspects, data describing an event can include a plurality of possible outcomes for the event, an end condition for the event and an identifier for the event.

In any of the foregoing aspects, data describing a wager for an event can include a probability distribution for the plurality of possible outcomes for the event, an amount, an identifier of a participant and an identifier of the event.

In any of the foregoing aspects, data describing a participant can include an identifier of the participant and authorization information for the participant.

In any of the foregoing aspects, data describing a wager can be either stored, or not stored, in the persistent storage, if the wager is not valid.

In any of the foregoing aspects, the server computer processes transactions for a plurality of events.

Having now described an example implementation of an online wagering system on a computer system, an example implementation of a computer as may be used to implement such a computer system will now be described. The computer generally includes computer hardware, such as described in FIG. 8 below, and computer programs providing instructions to be executed by the computer. Computer programs on a general purpose computer generally include an operating system and applications. The operating system is a computer program running on the computer that manages access to various resources of the computer by the applications and the operating system. The various resources generally include memory, storage, communication interfaces, input devices and output devices.

The computer can be any type of general-purpose or special-purpose computer, such as a tablet computer, hand held computer, smart phone, laptop or notebook computer, wearable computing device, or any other computing device, regardless of size or environment, more details and examples of which are discussed below in connection with FIG. 6.

Figure 6:
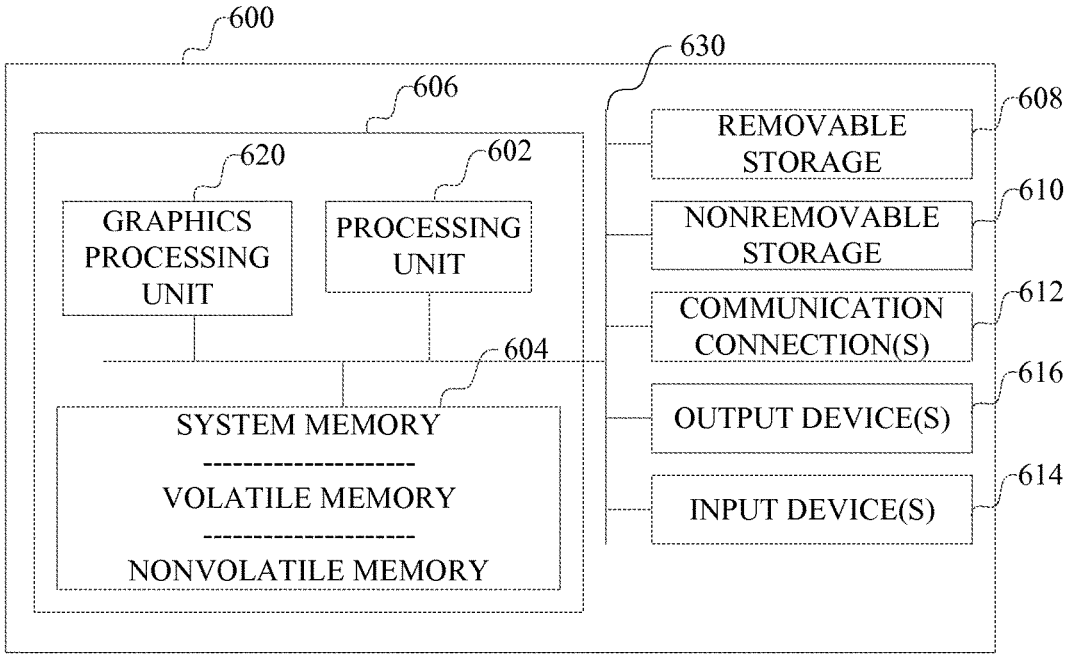
FIG. 6 is a block diagram of an example computer with which components of such a system can be implemented.

FIG. 6 illustrates an example of computer hardware of a computer with which the various components of the system of FIGS. 1-5 can be implemented using computer programs executed on this computer hardware. The computer hardware can include any of a variety of general purpose or special purpose computing hardware configurations. Some examples of types of computers that can be used include, but are not limited to, personal computers, game consoles, set top boxes, hand-held or laptop devices (for example, media players, notebook computers, tablet computers, cellular phones, personal data assistants, voice recorders), server computers, multiprocessor systems, microprocessor-based systems, programmable consumer electronics, network PCs, minicomputers, mainframe computers, and distributed computing environments that include any of the above types of computers or devices, and the like.

With reference to FIG. 6, an example computer 600 includes at least one processing unit 602 and memory 604. The computer can have multiple processing units 602 and multiple devices implementing the memory 604. A processing unit 602 can include one or more processing cores (not shown) that operate independently of each other. Additional co-processing units, such as graphics processing unit 620, also can be present in the computer. The memory 604 may include volatile devices (such as dynamic random access memory (DRAM) or other random access memory device), and non-volatile devices (such as a read-only memory, flash memory, and the like) or some combination of the two. This configuration of memory is illustrated in FIG. 6 by dashed line 606. The computer 600 may include additional storage (removable and/or non-removable) including, but not limited to, magnetically-recorded or optically-recorded disks or tape. Such additional storage is illustrated in FIG. 6 by removable storage 608 and non-removable storage 610. The various components in FIG. 6 are generally interconnected by an interconnection mechanism, such as one or more buses 630.

A computer storage medium is any medium in which data can be stored in and retrieved from addressable physical storage locations by the computer. Computer storage media includes volatile and nonvolatile memory devices, and removable and non-removable storage media. Memory 604 and 606, removable storage 608 and non-removable storage 610 are all examples of computer storage media. Some examples of computer storage media are RAM, ROM, EEPROM, flash memory or other memory technology, CD-ROM, digital versatile disks (DVD) or other optically or magneto-optically recorded storage device, magnetic cassettes, magnetic tape, magnetic disk storage or other magnetic storage devices. Computer storage media and communication media are mutually exclusive categories of media.

Computer 600 may also include communications connection(s) 612 that allow the computer to communicate with other devices over a communication medium. Communication media typically transmit computer program instructions, data structures, program modules or other data over a wired or wireless substance by propagating a modulated data signal such as a carrier wave or other transport mechanism over the substance. The term "modulated data signal" means a signal that has one or more of its characteristics set or changed in such a manner as to encode information in the signal, thereby changing the configuration or state of the receiving device of the signal. By way of example, and not limitation, communication media includes wired media such as a wired network or direct-wired connection, and wireless media include any non-wired communication media that allows propagation of signals, such as acoustic, electromagnetic, electrical, optical, infrared, radio frequency and other signals. Communications connections 612 are devices, such as a network interface or radio transmitter, that interface with the communication media to transmit data over and receive data from signals propagated through communication media.

Computer 600 may have various input device(s) 614 such as a keyboard, mouse, pen, camera, microphone, touch input device, sensors, and so on. Output device(s) 616 such as a display, speakers, a printer, and so on may also be included. All of these devices are well known in the art and need not be discussed at length here. Various input and output devices can implement a natural user interface (NUI), which is any interface technology that enables a user to interact with a device in a "natural" manner, free from artificial constraints imposed by input devices such as mice, keyboards, remote controls, and the like.

Examples of NUI methods include those relying on speech recognition, touch and stylus recognition, gesture recognition both on screen and adjacent to the screen, air gestures, head and eye tracking, voice and speech, vision, touch, gestures, and machine intelligence, and may include the use of touch sensitive displays, voice and speech recognition, intention and goal understanding, motion gesture detection using depth cameras (such as stereoscopic camera systems, infrared camera systems, and other camera systems and combinations of these), motion gesture detection using accelerometers or gyroscopes, facial recognition, three dimensional displays, head, eye, and gaze tracking, immersive augmented reality and virtual reality systems, all of which provide a more natural interface, as well as technologies for sensing brain activity using electric field sensing electrodes (EEG and related methods).

The various storage 610, communication connections 612, output devices 616 and input devices 614 can be integrated within a housing with the rest of the computer, or can be connected through various input/output interface devices on the computer, in which case the reference numbers 610, 612, 614 and 616 can indicate either the interface for connection to a device or the device itself as the case may be.

Each component (which also may be called a "module" or "engine" or the like), of a computer system such as described in FIGS. 1-5 above, and which operates on a computer, can be implemented using the one or more processing units of the computer and one or more computer programs processed by the one or more processing units. A computer program includes computer-executable instructions and/or computer-interpreted instructions, such as program modules, which instructions are processed by one or more processing units in the computer. Generally, such instructions define routines, programs, objects, components, data structures, and so on, that, when processed by a processing unit, instruct the processing unit to perform operations on data or configure the processor or computer to implement various components or data structures.

This computer system may be practiced in distributed computing environments where operations are performed by multiple computers that are linked through a communications network. In a distributed computing environment, computer programs may be located in both local and remote computer storage media.

Alternatively, or in addition, the functionality of one or more of the various components described herein can be performed, at least in part, by one or more hardware logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

It should be understood that the subject matter defined in the appended claims is not necessarily limited to the specific implementations described above. The specific implementations described above are disclosed as examples only.

What is claimed is:

1. A computer system comprising:

a server computer, comprising a processor and memory connected to the processor to allow access by the processor to data stored in the memory, and persistent storage connected to the processor to allow access by the processor to data stored in the persistent storage, and a network interface connected to the processor and the memory to allow access by the computer to a computer network and communicate messages over the computer network;

computer program instructions stored in at least one of the memory and persistent storage of the computer that, when processed by the processor, instruct the processor to:

while each event is active, receive messages over the computer network from user devices, received messages each including data indicative of an event, data indicative of a wager for the event, and data indicative of a participant, wherein the data indicative of the wager includes data indicative of at least an amount and a probability distribution for outcomes for the event;

process each message to:

determine if the message includes a valid wager;

store the data indicative of the wager, the participant and the event in the persistent storage if the message includes a valid wager;

continuously monitor a termination condition for each event to determine whether the event has terminated;

upon termination of an event, process the data indicative of valid wagers for the event stored in the persistent storage according to a payoff function for the event and an actual outcome of the event, so as to compute a payoff for each participant having placed a valid wager for the event, wherein to compute the payoff function the processor is instructed to:

compute a first score for the participant based on the probability estimate from the wager by the participant and the outcome, compute a second score based on an aggregate of wagers of all other participants, wherein, for each participant, the first score for the participant is no more than the second score for at least one outcome, and compute the payoff of the participant as a function of the first score and the second score, wherein, to compute the function of the first score and the second score, the processor is further instructed to:

compute a difference between the first score and the second score, compute a weight for the participant based on the amount of the wager of the participant and the amounts of the wagers of other participants, and compute the payoff using the weight and the difference between the first score and the second score.

2. The computer system of claim 1, wherein to compute the payoff using the weight and the difference, the processor is instructed to compute the weight times the difference.

3. The computer system of claim 1, wherein, to compute the weight for the participant, the processor is instructed to compute a function of the amount of the wager of the participant and a total of the amounts of the wagers of all other participants.

4. The computer system of claim 1, wherein, to compute the weight for the participant, the processor is instructed to compute the amount of the wager of the participant times a total of the amounts of the wagers of all other participants divided by a total number of all participants.

5. The computer system of claim 1, wherein, to compute the first score, the processor is instructed to compute 1 minus a squared difference between the probability estimate from the wager by the participant and the actual outcome.

6. The computer system of claim 1, wherein, to compute the second score, the processor is instructed to compute a sum, over all other participants, of the amounts of the wagers times the probability distributions from the wagers by the other participants, divided by a total of the amounts of the wagers of the other participants.

7. The computer system of claim 1, wherein the persistent storage includes a database that stores the data indicative of the events, the wagers and the participants.

8. The computer system of claim 1, further comprising a database, comprising:

a database computer executing a database management system, the database computer including the persistent storage and connected to the server computer over a computer network, the database computer responsive to requests from the server computer to access data stored in the persistent storage.

9. The computer system of claim 1, wherein data describing an event includes a plurality of possible outcomes for the event, an end condition for the event and an identifier for the event.

10. The computer system of claim 1, wherein data describing a wager for an event includes a probability distribution for the plurality of possible outcomes for the event, an amount, an identifier of a participant and an identifier of the event.

11. The computer system of claim 1, wherein data describing a participant includes an identifier of the participant and authorization information for the participant.

12. A computer implemented process performed by a server computer, comprising a processor, memory connected to the processor to allow access by the processor to data stored in the memory, and persistent storage connected to the processor to allow access by the processor to data stored in the persistent storage and a network interface connected to the processor and the memory to allow access by the computer to a computer network and communicate messages over the computer network, and having computer program instructions stored in at least one of the memory and persistent storage of the computer that, when processed by the processor, instruct the processor to perform a process comprising:

while each event is active, receiving messages over the computer network from user devices, received messages each including data indicative of an event, data indicative of a wager for the event, and data indicative of a participant, wherein the data indicative of the wager includes data indicative of at least an amount and a probability distribution for outcomes for the event;

processing each message by:

determining if the message includes a valid wager;

storing the data indicative of the wager, the participant and the event in the persistent storage if the message includes a valid wager;

continuously monitoring a termination condition for each event to determine whether the event has terminated;

upon termination of an event, processing the data indicative of valid wagers for the event stored in the persistent storage according to a payoff function for the event and an actual outcome of the event, so as to compute a payoff for each participant having placed a valid wager for the event, wherein computing the payoff function comprises:

computing a first score for the participant based on the probability estimate from the wager by the participant and the outcome, computing a second score based on an aggregate of wagers of all other participants, wherein, for each participant, the first score for the participant is no more than the second score for at least one outcome, computing the payoff of the participant as a function of the first score and the second score, wherein, computing the function of the first score and the second score comprises:

computing a difference between the first score and the second score, computing a weight for the participant based on the amount of the wager of the participant and the amounts of the wagers of other participants, and computing the payoff using the weight and the difference between the first score and the second score.

13. The computer implemented process of claim 12, wherein the persistent storage includes a database that stores the data indicative of the events, wagers and participants.

14. The computer implemented process of claim 12, wherein computing the payoff further comprises requesting the data describing wagers from a database computer executing a database management system that accesses data stored in the persistent storage.

15. The computer implemented process of claim 12, wherein data describing a wager for an event includes a probability distribution for the plurality of possible outcomes for the event, an amount, an identifier of a participant and an identifier of the event.

16. An article of manufacture comprising:

computer storage having computer program instructions stored in the computer storage, that, when executed by a computer having a processor, memory connected to the processor to allow access by the processor to data stored in the memory, and persistent storage connected to the processor to allow access by the processor to data stored in the persistent storage and a network interface connected to the processor and the memory to allow access by the computer to a computer network and communicate messages over the computer network, wherein the computer program instructions, when processed by the processor, instruct the processor to perform a process comprising:

while each event is active, receiving messages over the computer network from user devices, received messages each including data indicative of an event, data indicative of a wager for the event, and data indicative of a participant, wherein the data indicative of the wager includes data indicative of at least an amount and a probability distribution for outcomes for the event;

processing each message by:

determining if the message includes a valid wager;

storing the data indicative of the wager, the participant and the event in the persistent storage if the message includes a valid wager;

continuously monitoring a termination condition for each event to determine whether the event has terminated;

upon termination of an event, processing the data indicative of valid wagers for the event stored in the persistent storage according to a payoff function for the event and an actual outcome of the event, so as to compute a payoff for each participant having placed a valid wager for the event, wherein computing the payoff function comprises:

computing a first score for the participant based on the probability estimate from the wager by the participant and the outcome, computing a second score based on an aggregate of wagers of all other participants, wherein, for each participant, the first score for the participant is no more than the second score for at least one outcome, computing the payoff of the participant as a function of the first score and the second score, wherein, computing the function of the first score and the second score comprises:

computing a difference between the first score and the second score, computing a weight for the participant based on the amount of the wager of the participant and the amounts of the wagers of other participants, and computing the payoff using the weight and the difference between the first score and the second score.

17. The article of manufacture of claim 16, wherein the persistent storage includes a database that stores the data indicative of the events, wagers and participants.

18. The article of manufacture of claim 16, wherein computing the payoff further comprises requesting the data describing wagers from a database computer executing a database management system that accesses data stored in the persistent storage.

19. The article of manufacture of claim 16, wherein data describing a wager for an event includes a probability distribution for the plurality of possible outcomes for the event, an amount, an identifier of a participant and an identifier of the event.

20. The computer implemented process of claim 12, wherein computing the payoff using the weight and the difference comprises computing the weight times the difference.

21. The computer implemented process of claim 12, wherein computing the weight for the participant comprises computing a function of the amount of the wager of the participant and a total of the amounts of the wagers of all other participants.

22. The computer implemented process of claim 12, wherein computing the weight for the participant comprises computing the amount of the wager of the participant times a total of the amounts of the wagers of all other participants divided by a total number of all participants.

23. The computer implemented process of claim 12, wherein computing the first score comprises computing 1 minus a squared difference between the probability estimate from the wager by the participant and the actual outcome.

24. The computer implemented process of claim 12, wherein computing the second score comprises computing a sum, over all other participants, of the amounts of the wagers times the probability distributions from the wagers by the other participants, divided by a total of the amounts of the wagers of the other participants.

25. The article of manufacture of 16, wherein computing the payoff using the weight and the difference comprises computing the weight times the difference.

26. The article of manufacture of 16, wherein computing the weight for the participant comprises computing a function of the amount of the wager of the participant and a total of the amounts of the wagers of all other participants.

27. The article of manufacture of 16, wherein computing the weight for the participant comprises computing the amount of the wager of the participant times a total of the amounts of the wagers of all other participants divided by a total number of all participants.

28. The article of manufacture of 16, wherein computing the first score comprises computing 1 minus a squared difference between the probability estimate from the wager by the participant and the actual outcome.

29. The article of manufacture of 16, wherein computing the second score comprises computing a sum, over all other participants, of the amounts of the wagers times the probability distributions from the wagers by the other participants, divided by a total of the amounts of the wagers of the other participants.

* * * * *